United States Patent [19]

Adkins

[11] Patent Number: 4,940,392

[45] Date of Patent: Jul. 10, 1990

[54] JET PUMP WITH STABILIZED MIXING OF PRIMARY AND SECONDARY FLOWS

[75] Inventor: Richard C. Adkins, Buckinghamshire, England

[73] Assignee: British Aerospace PLC, London, England

[21] Appl. No.: 294,999

[22] Filed: Jan. 9, 1989

Related U.S. Application Data

[63] Continuation of Ser. No. 131,500, Aug. 3, 1987, abandoned.

[30] Foreign Application Priority Data

Aug. 7, 1986 [GB] United Kingdom ..... 8619277

[51] Int. Cl.[5] ..... F04F 3/00

[52] U.S. Cl. ..... 417/151; 417/196; 181/218; 181/270

[58] Field of Search ..... 417/151, 159, 196, 198, 417/54, 178, 197, 196, 198; 60/39.49, 755, 264, 269, 319; 239/265.15, 265.19, 265.11, 432; 366/340

[56] References Cited

U.S. PATENT DOCUMENTS

| | | | |
|---|---|---|---|
| 2,180,259 | 11/1939 | Sargent | 417/159 |
| 2,358,386 | 9/1944 | Doll | 239/432 |
| 2,375,180 | 5/1945 | Vigo | 417/151 |
| 2,571,871 | 10/1951 | Hayes | 417/198 X |
| 3,494,296 | 2/1970 | Gluntz | 417/196 |
| 3,545,886 | 12/1970 | Chalom | 417/196 |
| 3,942,724 | 3/1976 | Mocarski | 239/417 |

FOREIGN PATENT DOCUMENTS

| | | | |
|---|---|---|---|
| 1210899 | 3/1960 | France . | |
| 2208465 | 6/1974 | France . | |
| 151000 | 8/1984 | Japan | 417/151 |
| 47900 | 3/1985 | Japan | 417/151 |
| 200437 | 12/1938 | Switzerland | 417/198 |
| 620681 | 8/1978 | U.S.S.R. | 417/196 |
| 644971 | 1/1979 | U.S.S.R. | 417/151 |

OTHER PUBLICATIONS

Russian–English Chemical and Polytechnical Dictionary (Third Edition) p. 245, 1975.

*Primary Examiner*—Leonard E. Smith
*Assistant Examiner*—Robert N. Blackmon
*Attorney, Agent, or Firm*—Venable, Baetjer & Howard

[57] ABSTRACT

A jet pump comprises a nozzle (1) for a high speed primary flow, a mixing tube (2) into which the primary flow is directed by the nozzle (1), and an inlet (3) to the mixing tube (2) for a secondary flow, the inlet (3) surrounding the primary flow nozzle (1). Means (2') is provided for changing the cross section of the mixing tube (2) abruptly in order to produce a rise in static pressure immediately downstream, thereby increasing mixing of the primary and secondary flows, stabilizing the mixing process and enabling significant noise reduction when used in engine testing apparatus.

6 Claims, 4 Drawing Sheets

JET PUMP WITH STABILIZED MIXING OF PRIMARY AND SECONDARY FLOWS

This application is a continuation of application Ser. No. 131,500, filed Aug. 3, 1987, now abandoned.

The present invention relates to jet pumps and, more particularly, to a means of stabilizing the process of mixing which takes place between primary and secondary flow through the pump.

Jet pumps have been known and used for many years and operate utilizing the entraining properties of a high speed jet of primary fluid in order to pump a secondary fluid. A simplified example of a jet pump is shown, in FIG. 1, to comprise a primary nozzle 1 through which a high pressure primary fluid accelerates up to a high velocity into a mixing tube 2 which is located coaxially with the nozzle 1. The mixing tube 2 has a secondary inlet 3 surrounding the primary fluid nozzle 1 through which the secondary fluid is induced to enter. The inlet 3 usually comprises an aerodynamically faired inlet designed to reduce any pressure loss which might be incurred by the entrained fluid as it enters the mixing tube 2. The mixing tube 2 is of constant cross-sectional area and of sufficient length to enable adequate mixing of the primary and secondary fluids such that the velocity distribution at the exit end of the tube is substantially uniform. Typically the length of the mixing tube will be equal to at least six times its diameter when the configuration is a cylindrical one. A diffuser 4 is located at the exit end of the mixing tube 2 so that at least part of the kinetic energy at the end of the mixing tube can be converted into an increase in static pressure before the fluid is finally delivered from the apparatus. As a result of this action the diffuser creates a region of low pressure at its inlet which, in turn, is propagated upstream to the inlet of the mixer tube and so assists in the entrainment of the secondary stream of fluid.

One particular use of jet pumps is in the testing of gas turbine engines where the outlet of the engine provides a primary flow of fluid to a jet pump apparatus, ambient air being drawn in as a secondary fluid in order both to reduce the velocity of the exit gases from the engine to reduce the temperature of the exhaust jet, enabling testing to take place in relatively confined areas. However, the problem of instability in the jet pump creates a large noise problem.

Although there is a wide range of possible uses for such jet pumps the mixing process between the primary and secondary fluids is relatively inefficient so that they have not achieved wide-scale use. The inefficiency of the mixing process reduces driving pressure, requires the jet pump to have a considerable length in order to achieve adequate mixing, and can give rise to noise and flow instability, particularly when the primary stream is supersonic.

The present invention is directed to overcoming the problems associated with inefficient mixing of the primary and secondary flows through the jet pump.

According to the present invention there is provided a jet pump which comprises a nozzle for a high speed primary flow, a mixing tube into which the primary flow is directed by the nozzle, and an inlet to the mixing tube for a secondary flow, the inlet surrounding the primary flow nozzle, characterized by means in the mixing tube for changing the cross section of the mixing tube abruptly in order to produce a rise in static pressure immediately downstream, thereby increasing mixing of the primary and secondary flows and stabilizing the mixing process.

The means for changing the cross-section of the mixing tube is preferably located towards the inlet end of the mixing tube and may comprise a stepped or ramped increase in the cross-sectional area of the tube proper, but may also or alternatively include an orifice plate or fence. In a further alternative the diameter of the wall of the mixing tube is increased over a short longitudinal distance to provide an annular groove in the wall of the mixing tube.

It has been found that the velocity distribution towards the end of the mixing tube can be made considerably more uniform and that fluctuations in pressure are reduced, i.e. stability is increased, and that mixing of the primary and secondary flows is enhanced. This enables the length of the mixing tube to be reduced from the conventional length and enables a reduction in noise to be achieved as well. This is particularly significant in engine testing applications where high noise levels can be a major environmental nuisance.

Four examples of jet pumps constructed in accordance with the present invention will now be described with reference to the accompanying drawings in which.

Figure 1:
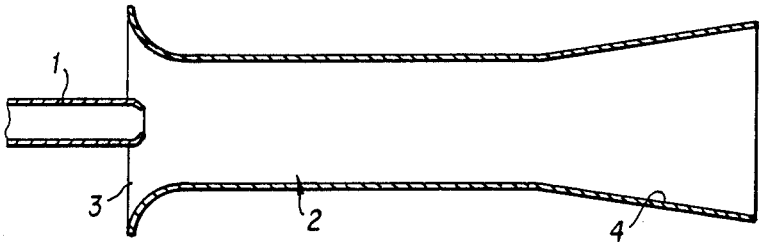
FIG. 1 PRIOR ART
FIG. 1 shows a conventional jet pump in longitudinal section.
Figure 2:
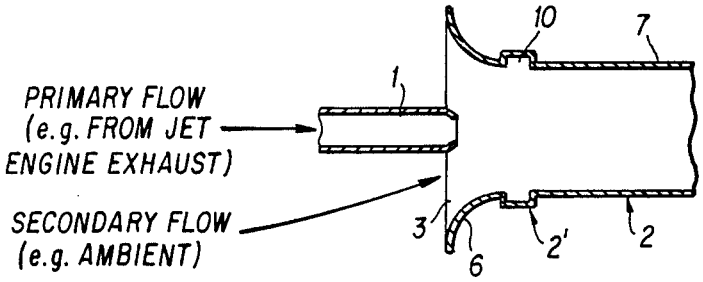
FIG. 2 shows a portion of a jet pump in longitudinal section.

FIG. 2 shows a mixing tube 2 formed with a means 2' for changing the cross-section of the mixing tube 2, which comprises an annular groove 10 between the wall 6 of the mixer inlet and the wall 7 of the tube 2. The annular groove 10 is formed over a relatively short longitudinal distance, and the depth of the groove 10 is of the order of 10% of the diameter of the mixing tube 2.

Figure 3:
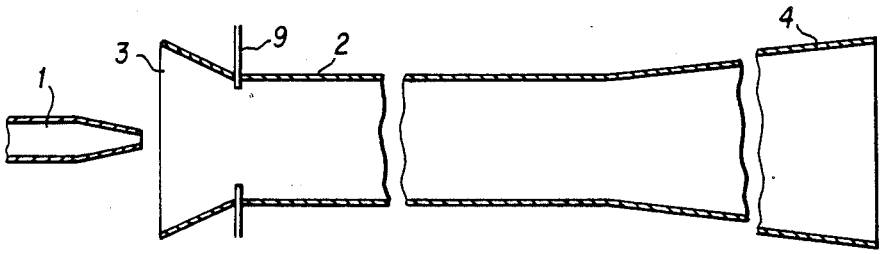
FIG. 3 shows a fourth example according to the invention, in greater detail.

FIG. 3 shows a jet pump having a primary nozzle 1 of 8 mm diameter emitting a primary jet into a mixing tube of diameter 28 mm and length 235 mm and containing an orifice plate 9 positioned closely adjacent the inlet 3, thus providing a reduced cross-sectional area for the combined flow. The diameter of the orifice 9' shown is 22.5 mm. The mixing tube extends into a diffuser 4 having a length of 240 mm and an outlet diameter of 45 mm. The orifice plate protrudes only part of the way towards the high velocity jet of primary fluid and it is important to ensure that the primary jet does not impinge on the orifice plate.

In a comparison test with a jet pump having the same dimensions, but without the orifice plate, it was found that a primary jet of air driven through the nozzle 1 at a driving pressure of 30 psi, the fluctuation of the static pressure about the mean at a series of positions along the wall of the mixing tube was dramatically reduced.

Figure 4A:
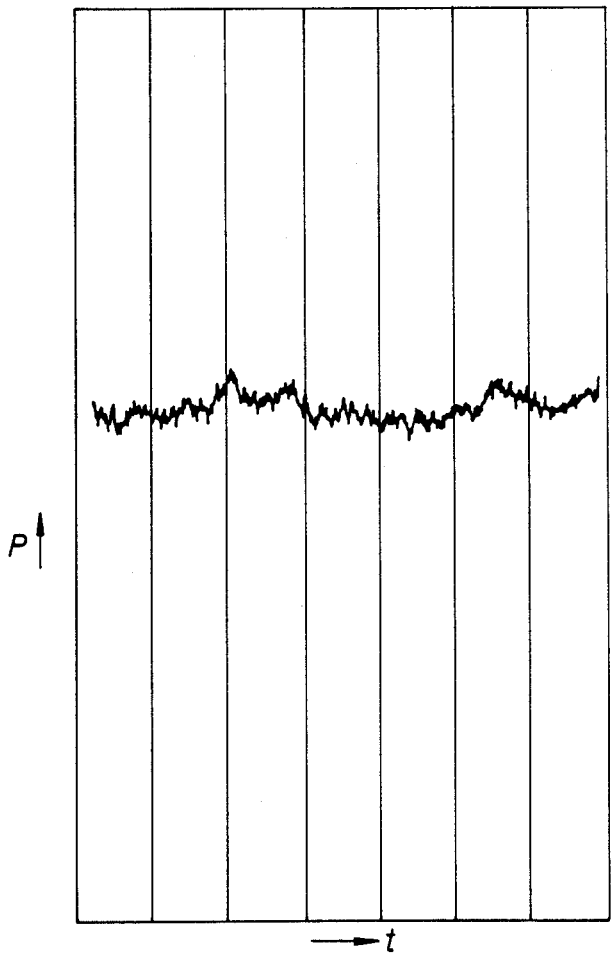
FIGS. 4A and 4B show trace recordings of static pressure in the jet pump of FIG. 4 and a prior art jet pump respectively; and, FIG. 5 illustrates in graph form the fluctuations in pressure along the wall of the mixing tube of the example shown in FIG. 4 in comparison with a conventional jet pump of identical dimensions.
Figure 4B:
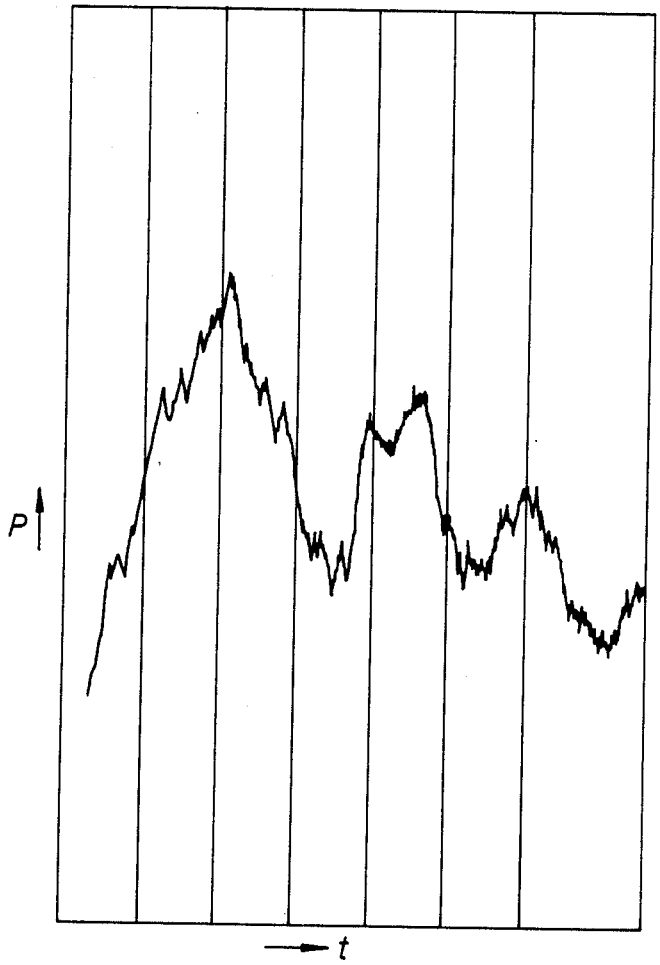

FIGS. 4A and 4B show trace recordings of static pressure P against time t measured under identical conditions at a location on the wall of the mixing tube downstream of the inlet 3, (A) when an orifice plate as shown in FIG. 3 is in position in the mixing tube 2 and (B) when it is not present in the mixing tube, FIGS. 4A and 4B clearly illustrating the smoothing in pressure variation which is achieved.

Figure 5:
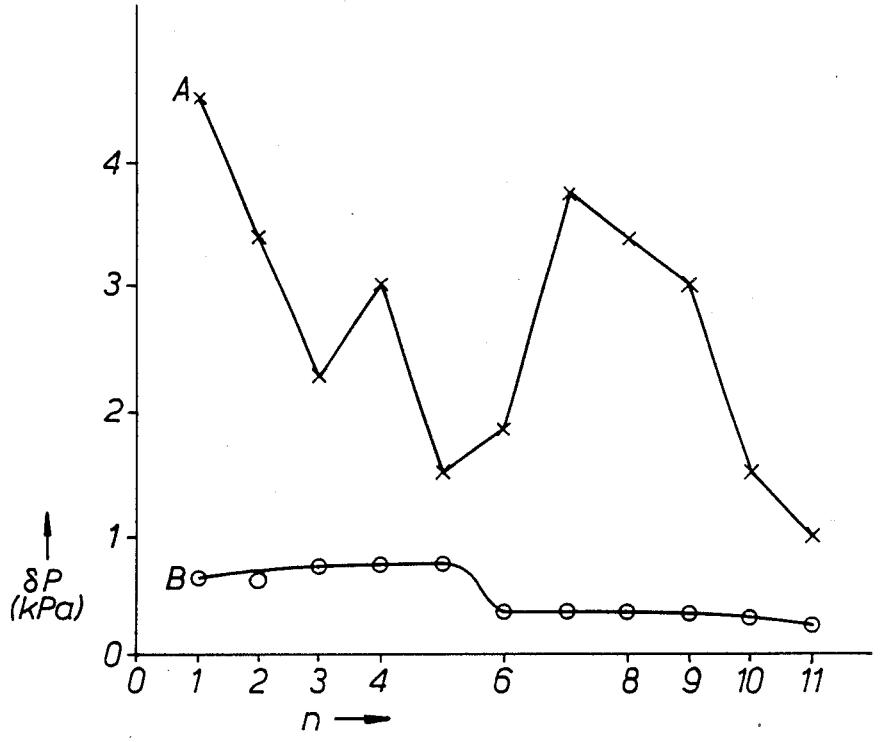

A series of tapping points n (not shown in FIG. 3) were also used to measure static pressure, the tapping points being spaced at intervals of 20 mm along the length of the mixing tube starting from the orifice plate. It can be seen from FIG. 5 that although the level of pressure fluctuation $\delta P$ (measured in kPa) about the mean reduces in the downstream direction in the conventional jet pump (curve A), the level of fluctuation in the example of the invention (curve B) is significantly reduced all along the tube, to a level less than about half that of the fluctuation in the conventional pump.

It will be appreciated that other formations within the mixing tube 2 may be provided within the scope of the invention.

I claim:

1. A jet pump for reducing the noise generated by the flow of exhaust gas from a jet engine comprising:

a nozzle for a high speed primary flow produced by the exhaust of said jet engine;

a mixing tube into which said primary flow is directed by said nozzle;

an inlet to said mixing tube for a secondary flow, said inlet surrounding said primary flow nozzle; and an orifice plate located in said mixing tube for changing the cross section of said mixing tube abruptly, in order to produce a rise in static pressure immediately downstream, thereby increasing mixing of the primary and secondary flows and stabilizing the mixing process.

2. A jet pump according to claim 1, wherein:

said orifice plate is located towards the inlet end of said mixing tube.

3. A jet pump comprising:

a nozzle for a high speed primary flow;

a mixing tube into which said primary flow is directed by said nozzle;

an inlet to said mixing tube for a secondary flow, said inlet surrounding said primary flow nozzle; and said mixing tube having a wall, said wall having an annular groove formed therein by an increase in the diameter of said wall of said mixing tube over a short longitudinal distance, said groove serving to change the cross section of said mixing tube abruptly in order to produce a rise in static pressure immediately downstream of said primary flow, thereby increasing mixing of the primary and secondary flows and stabilizing the mixing process.

4. A jet pump according to claim 3, wherein:

said groove is located towards the inlet end of said mixing tube.

5. A method for reducing the noise generated by the flow of exhaust gas from a jet engine under test using a jet pump which comprises:

a nozzle for said exhaust gas flow;

a mixing tube into which said exhaust gas flow is directed by said nozzle;

an inlet to said mixing tube for a secondary flow said secondary flow being sucked into the mixing tube by entraining action of the exhaust gas flow, wherein said inlet surrounds said primary flow nozzle and wherein an orifice plate located in said mixing tube for changing the cross section of said mixing tube abruptly, in order to produce a rise in static pressure immediately downstream, thereby increasing mixing of the exhaust gas and secondary flows and stabilizing the mixing process.

6. A method for reducing the noise generated by the flow of exhaust gas from a jet engine under test using a jet pump which comprises:

a nozzle for said exhaust gas flow;

a mixing tube into which said exhaust gas flow is directed by said nozzle; and an inlet to said mixing tube for a secondary flow, said inlet surrounding said exhaust gas flow nozzle;

said mixing tube having a wall, said wall having an annular groove formed therein by an increase in the diameter of said wall over a short longitudinal distance, said groove serving to change the cross section of said mixing tube abruptly in order to produce a rise in static pressure immediately downstream, thereby increasing mixing of the exhaust gas and secondary flows and stabilizing the mixing process.

* * * * *